US006979255B2

(12) United States Patent
Yamada et al.

(10) Patent No.: US 6,979,255 B2
(45) Date of Patent: Dec. 27, 2005

(54) HOLDER FOR OPTICAL FIBER FERRULE END FACE GRINDING APPARATUS

(75) Inventors: Kunio Yamada, Matsudo (JP); Tatsuya Fujiwara, Matsudo (JP)

(73) Assignee: Seikoh Giken Co., Ltd., (JP)

( * ) Notice: Subject to any disclaimer, the term of this patent is extended or adjusted under 35 U.S.C. 154(b) by 179 days.

(21) Appl. No.: 10/726,609

(22) Filed: Dec. 4, 2003

(65) Prior Publication Data

US 2004/0110455 A1 Jun. 10, 2004

(30) Foreign Application Priority Data

Dec. 6, 2002 (JP) ..... P2002-355197

(51) Int. Cl.[7] ..... B24B 41/006

(52) U.S. Cl. ..... 451/364; 451/365; 451/390; 451/460; 269/287; 269/902

(58) Field of Search ..... 451/364, 365, 451/389, 390, 460, 909; 269/287, 902, 909

(56) References Cited

U.S. PATENT DOCUMENTS 5,321,917 A * 6/1994 Franklin et al. ..... 451/386
5,640,475 A * 6/1997 Takahashi ..... 385/85
6,238,278 B1 * 5/2001 Haftmann ..... 451/390
6,726,539 B2 * 4/2004 Nishi et al. ..... 451/41
6,755,719 B2 * 6/2004 Yoshida et al. ..... 451/6
6,808,444 B1 * 10/2004 Kuprin et al. ..... 451/364

FOREIGN PATENT DOCUMENTS

JP 2002-254306 9/2002
JP 2002-254307 9/2002

* cited by examiner

*Primary Examiner*—Hadi Shakeri
(74) *Attorney, Agent, or Firm*—Blank Rome LLP

(57) ABSTRACT

A holder for an optical fiber ferrule end face grinding apparatus is provided which can grind an increased number of optical fiber ferrules simultaneously. The holder comprises a holder plate provided with a plurality of ferrule insertion holes, a seat extending to at least one insertion hole and having a first wall, and a second wall on a side of the insertion hole opposing the seat. A slidable holding member including a front face facing the second wall, and an inclined rear face is disposed on the seat. A depression member is mounted on the holder plate that presses downwardly on a rod member disposed on the inclined rear face. As the depression member is operated, the rod member is pressed downwardly along the first wall, and the holding member is pushed forward such that a ferrule is clamped between the front face and the second wall.

20 Claims, 14 Drawing Sheets

HOLDER FOR OPTICAL FIBER FERRULE END FACE GRINDING APPARATUS

CROSS-REFERENCE TO RELATED APPLICATIONS

This application claims benefit of priority under 35 U.S.C. § 119 of Japanese Patent Application No. 2002-355197 filed Dec. 6, 2002, the entire contents of which are incorporated by reference herein.

BACKGROUND OF THE INVENTION

1. Field of the Invention

The present invention relates to an optical fiber ferrule end face grinding apparatus and more particularly to a holder that holds a plurality of optical fiber ferrules for grinding the end faces thereof.

2. Description of Relevant Art

Generally, an end face grinding (polishing) apparatus that simultaneously grinds a plurality of end faces of ferrules to each of which an optical fiber is attached (optical fiber ferrules) requires that a plurality of optical fiber ferrules be held in a holder mounted on an end face grinding apparatus. Generally, in this kind of holder for an end face grinding apparatus, each optical fiber ferrule is held in a holder plate by a securing member installed in the holder plate for positioning and holding a respective optical fiber ferrule.

In recent times, devices have been developed that provide more efficient usage of space in order to increase the number of optical fiber ferrules that can be ground at once by enabling one securing member to position and secure two or more optical fiber ferrules in a holder plate. Such holders for end face grinding apparatuses have been disclosed in Japanese Unexamined Patent Application Publication No. 2002-254306 and Japanese Unexamined Patent Application Publication No. 2002-254307.

However, in the inventions disclosed in both Japanese Unexamined Patent Application Publication No. 2002-254306 and Japanese Unexamined Patent Application Publication No. 2002-254307, the optical fiber ferrule is positioned on each peripheral surface of a polygonal plate-like holder plate (thus, where the holder plate has a hexagonal plate-like shape, each of six peripheral surfaces) and a securing member is installed on each peripheral surface of the holder plate with a screw member so as to hold each optical fiber ferrule to the holder plate. Accordingly, these prior art technologies require that a screw member be used to install a securing member to the holder plate. Furthermore, because this screw member must be screwed into a peripheral face of the holder plate for positioning an optical fiber ferrule, the optical fiber ferrule cannot be positioned in the location on the peripheral face in which this screw member is screwed. The result is that the peripheral surfaces of the holder plate cannot be used solely for positioning of an optical fiber ferrule thereby preventing the effective use of those surfaces.

SUMMARY OF THE INVENTION

In order to solve the aforementioned problem affecting a conventional holder for an optical fiber ferrule end face grinding apparatus, it is an object of this invention to achieve more effective use of space in a holder plate by providing a method for holding each optical fiber ferrule in the holder plate, thereby providing a holder for an optical fiber ferrule end face grinding apparatus that can grind an increased number of optical fiber ferrules at once and that realizes a reduction in the cost of grinding each optical fiber ferrule.

In order to realize the above objective, according to a first aspect of the present invention, a holder for an optical fiber ferrule end face grinding apparatus is provided that holds a plurality of optical fiber ferrules, the holder comprising a holder plate provided with a plurality of insertion holes into each of which one of the ferrules is inserted, a seat provided for all of the insertion holes that extends to one side of at least one of the insertion holes and has a first wall at a prescribed distance from the insertion hole, and a second wall provided on a side of the insertion hole opposing the seat;

a holding member disposed on each of the seats that is slidable in a direction to adjust the interval between the holding member and the second wall, the holding member including a front face facing the second wall, and a rear face that is inclined relative to the first wall;

a rod member disposed above the inclined rear face of each holding member; and a depression member provided on the holder plate at an outside of the first wall of each seat, that exerts depression pressure on a respective rod member, wherein by the operation of each depression member, each of the rod members is pressed downwardly along the first wall of each of the seats, by which action each of the holding members is pushed out forwardly such that each ferrule is held by the front face of the holding member and the second wall.

According to another aspect of the present invention, a holder for an optical fiber ferrule end face grinding apparatus is provided wherein the seat is provided for each group of adjacent insertion holes, the inclined rear face extends horizontally in a direction perpendicular to the direction of the sliding motion of the holder member, and the plurality of ferrules inserted in the adjacent insertion holes are held by the front face of the holding member disposed on each seat together with the second walls of the adjacent insertion holes.

According to yet another aspect of the invention, a holder for an optical fiber ferrule end face grinding apparatus is provided wherein the plurality of insertion holes are formed in a circular formation on the holder plate and each seat is provided at the outside in relation to the center of the circle formed by the insertion holes.

According to yet another aspect of the present invention, a holder for an optical fiber ferrule end face grinding apparatus is provided wherein each holding member is biased in a direction away from the second wall corresponding to the front face.

According to yet another aspect of the invention, a holder for an optical fiber ferrule end face grinding apparatus is provided wherein each second wall holds a ferrule by one or a plurality of faces depending on the shape of the ferrule.

According to yet another aspect of the invention, a holder for an optical fiber ferrule end face grinding apparatus is provided wherein the depression member comprises a washer and a bolt that is screwed into the holder plate from above.

According to yet another aspect of the present invention, a holder for an optical fiber ferrule end face grinding apparatus is provided wherein each insertion hole can be inclined perpendicularly or to a desired angle with respect to a planar surface of the holder plate.

BRIEF DESCRIPTION OF THE DRAWINGS

These and other objects, features and advantages of this invention will become clearer from the following description of the preferred embodiments, read in connection with the accompanying drawings in which.

DETAILED DESCRIPTION OF THE INVENTION

The embodiments of the present invention will now be described with reference to the drawings in which the same or similar numbers are used to represent the same or similar parts.

Figure 1:
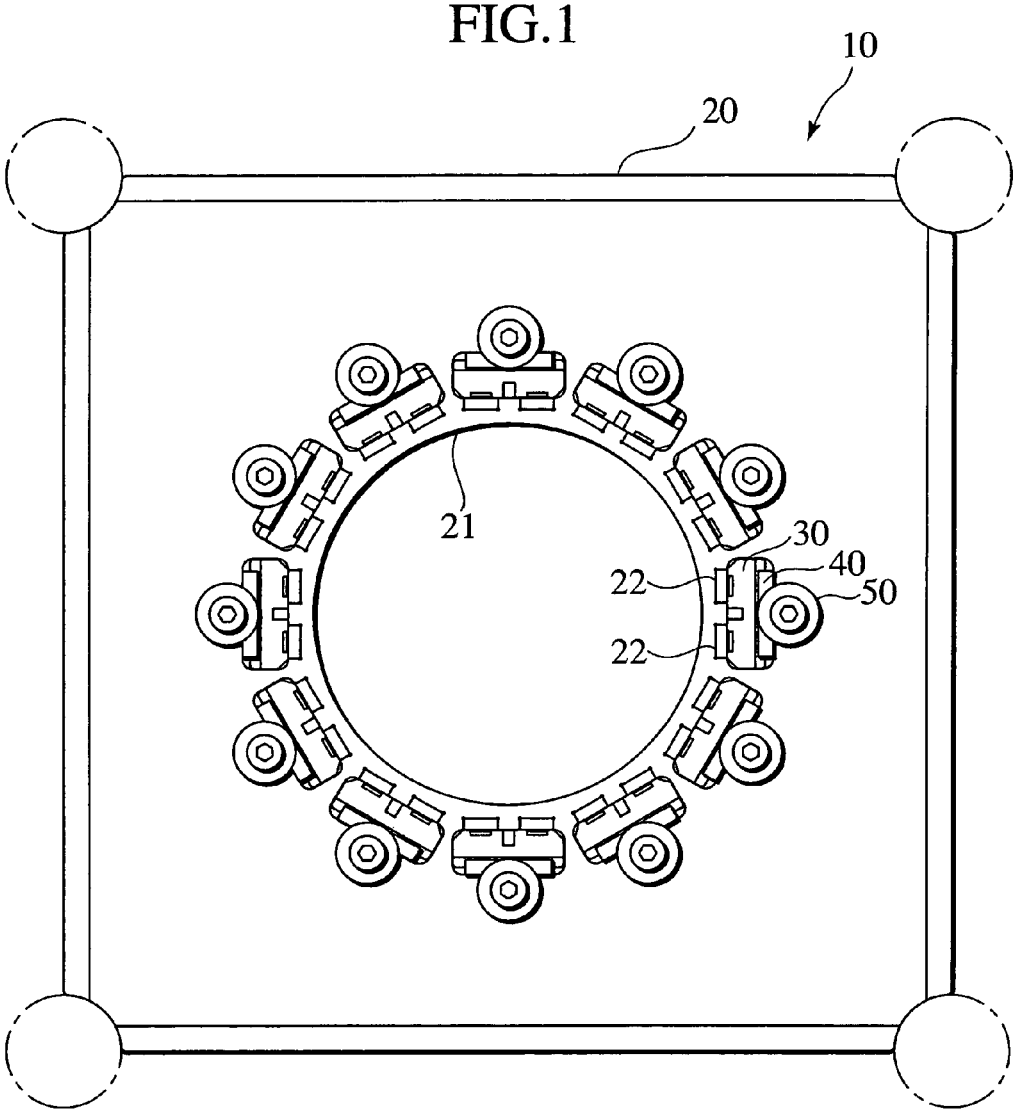
FIG. 1 is a plan view of a first embodiment of a holder for an optical fiber ferrule end face grinding apparatus according to the present invention.
Figure 2:
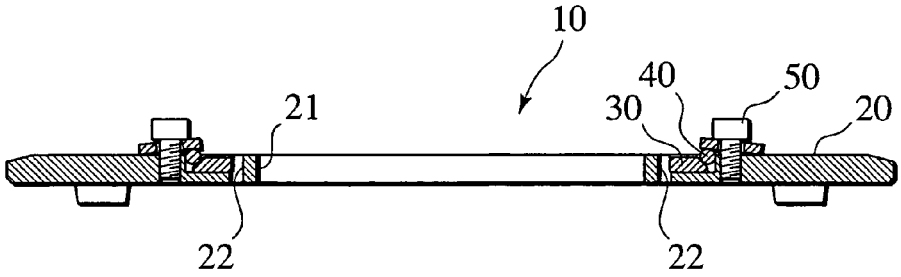
FIG. 2 is a longitudinal sectional view of the holder for an optical fiber ferrule end face grinding apparatus shown in FIG. 1.

FIG. 1 is a plan view of a first embodiment of a holder 10 for an optical fiber ferrule end face grinding apparatus according to the invention and FIG. 2 is a longitudinal sectional view of the holder 10 shown in FIG. 1. Holder 10 holds a plurality of mechanically transferable (MT) ferrules 1 (see FIGS. 5A and 5B) and mounts on an end face grinding apparatus, such as apparatus 60 shown in FIGS. 15 and 16. Here, the MT ferrule 1 to be held in the holder of FIGS. 1 and 2 is a rectangular cross-sectional ferrule through which an optical fiber ribbon 2 is inserted. Optical fiber ribbon 2 is formed of a plurality of optical fibers (not shown in the drawings) longitudinally arranged into a tape-shaped form.

Holder 10 for an optical fiber ferrule end face grinding apparatus comprises a holder plate 20 that mounts on optical fiber ferrule end face grinding apparatus 60 (see FIGS. 15 and 16), and a plurality of holding members 30, rod members 40 and depression members 50 which are disposed at predetermined positions on the holder plate 20.

The holder plate 20 is a square-shaped plate having a notch formed in each of the four corners thereof and a round hole 21 formed in the center. A plurality of insertion holes 22 through which an MT ferrule 1 is inserted is disposed in circular formation surrounding round hole 21. In the embodiment shown in FIG. 1, there are twenty-four (24) insertion holes, two for each holding member 30.

Figure 3A:
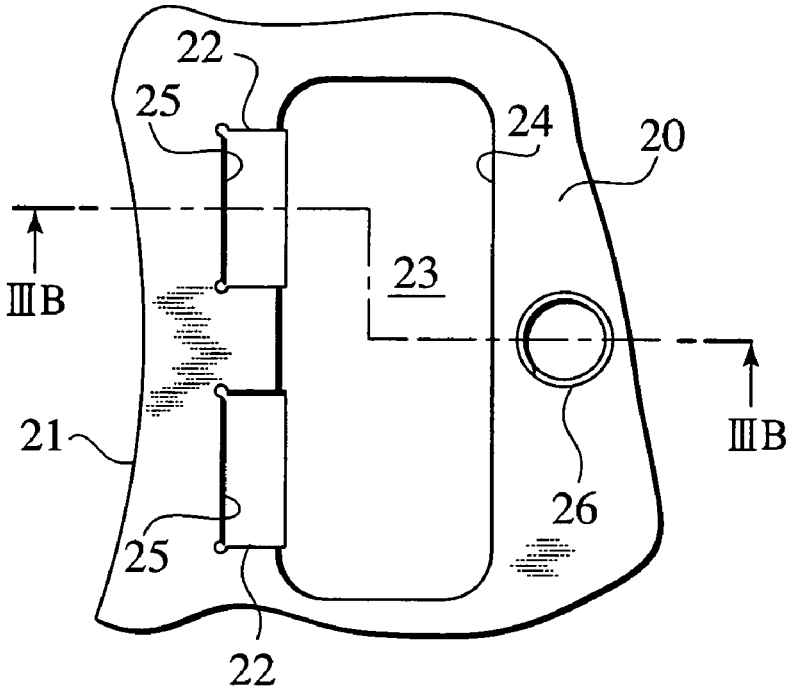
FIG. 3A is an enlarged fragmentary plan view of the major parts of the holder plate shown in FIG. 1.
Figure 3B:
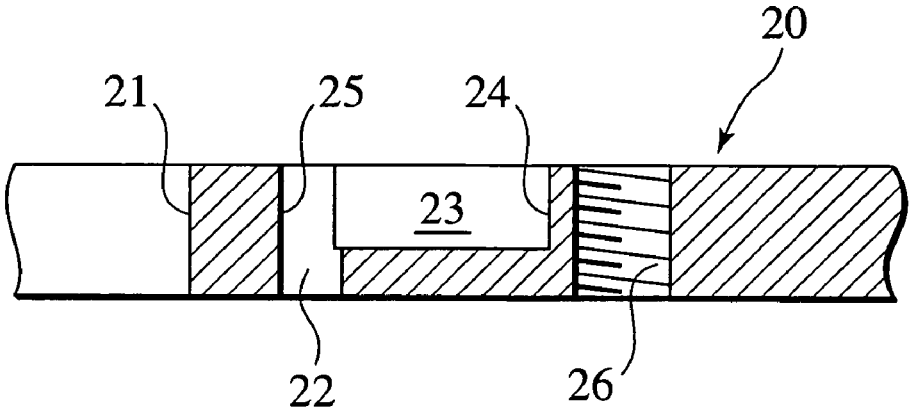
FIG. 3B is a longitudinal sectional view along the line IIIB—IIIB in FIG. 3A.

As shown in FIGS. 3A and 3B, because a rectangular cross-sectional MT ferrule 1 is to be inserted through an insertion hole 22, an insertion hole 22 is rectangular in form in a plan view. An insertion hole 22 is also of a size providing a degree of additional clearance to accommodate the rectangular cross-sectional form of the MT ferrule 1 and the two adjacent insertion holes 22 associated with each holding member 30 are formed along a straight line.

To one side of the two adjacent insertion holes 22 associated with each holding member 30 (that is, on the outer radial side in relation to the center of the hole 21), there is formed a seat 23 extending into these two insertion holes 22. A seat 23 is provided for each of the two adjacent insertion holes 22 associated with each holding member 30. On each seat 23 at a predetermined distance from the two insertion holes 22 there is formed a first wall 24 of the seat. Further, on the opposing side of the wall 24 of seat 23 there are two vertically extending second walls 25 formed by the innermost walls of the insertion holes 22. Additionally, radially outside of the first wall 24 of each seat 23, a threaded hole 26 is formed in the holder plate 20 for installing a depression member 50 in an intermediate position (midway) between the two insertion holes 22.

Figure 4A:
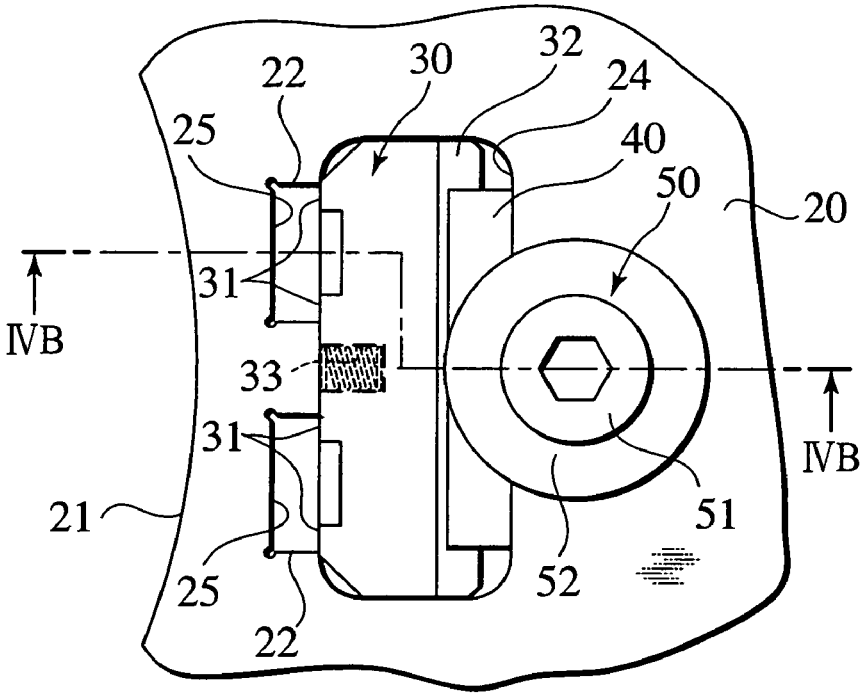
FIG. 4A is an enlarged fragmentary plan view of the major parts of the holder shown in FIG. 1.
Figure 4B:
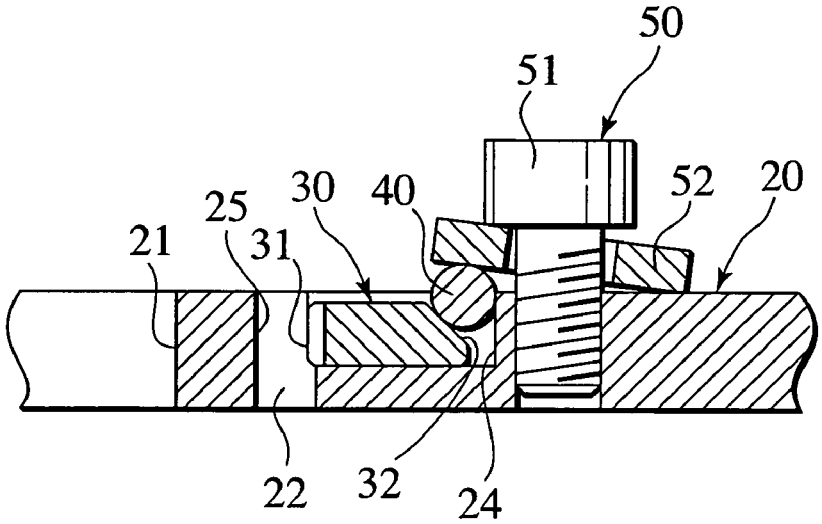
FIG. 4B is a longitudinal sectional view along the line IVB—IVB in FIG. 4A.

Referring now to FIGS. 4A and 4B, a holding member 30 is disposed on each seat 23 such that the holding member 30 can slide in a direction (radially in relation to the center of holder plate 20) required for adjusting the interval between the holding member 30 and the two second walls 25 of the two insertion holes 22 extending to the seat 23. Holding member 30 has a surface 31 at the front face thereof confronting the second walls 25 of the two insertion holes 22. In addition, holding member 30 has an inclined rear face 32 at the rear or radially outermost side thereof that is inclined relative to the first wall 24 of the seat 23 and extends in a direction perpendicular to the radial in and out sliding motion of the holding member 30. Holding member 30 is urged in a radial direction away from the second walls 25 by the operation of a helical compression spring 33 mounted in a bore in the front face 31 of the holding member 30.

A rod member 40 is disposed above and in contact with the inclined rear face 32 of the seated holding member 30 and in contact with the first wall 24 of the seat 23. The depression member 50 comprises a washer 52 and a hexagon socket head bolt 51 (e.g., an Allen cap screw) that is threaded into threaded hole 26 of the holder plate 20 from above. When tightened, the depression member 50 presses the rod member 40 downwardly against inclined rear face 32 of the holding member 30.

In accordance with the above-described construction of the holder 10 for an optical fiber ferrule end face grinding apparatus, when the hexagon socket head bolt 51 is loosened or unthreaded, the front face 31 is in a condition retracted away from the two insertion holes 22 because the holding member 30 is urged by the operation of the helical compression spring 33 in the radial direction away from the second walls 25. In this condition, an MT ferrule 1 can be readily inserted in either of the two insertion holes 22 for each holding member position.

Figure 5A:
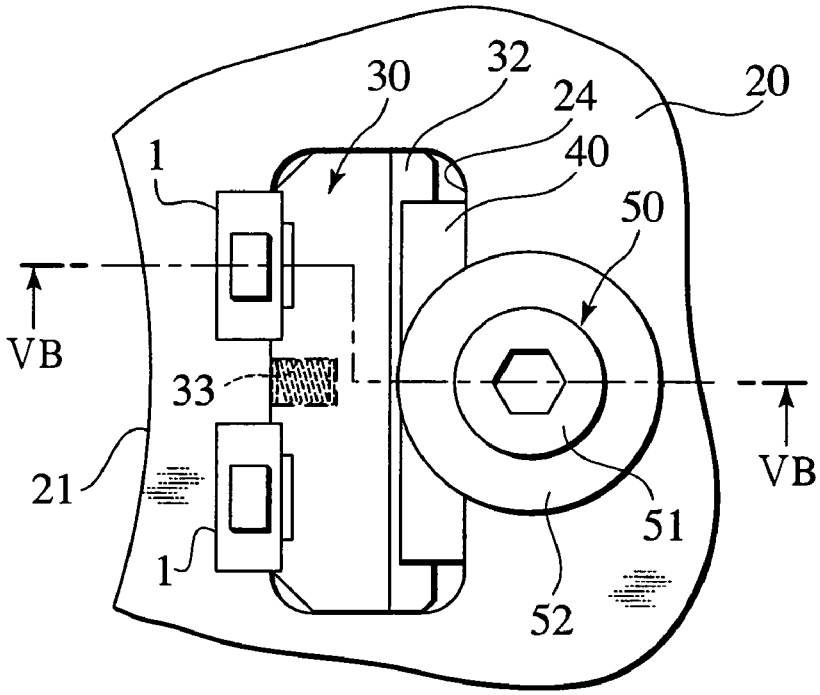
FIG. 5A is an enlarged fragmentary plan view showing an MT ferrule attached to the holder shown in FIG. 1.
Figure 5B:
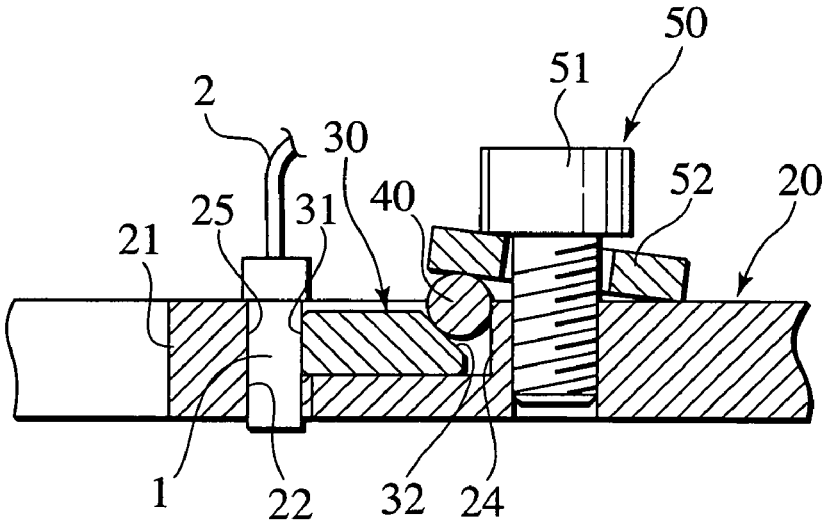
FIG. 5B is a longitudinal sectional view along the line VB—VB in FIG. 5A.

As shown in FIGS. 5A and 5B, after an MT ferrule 1 is inserted in each of the two insertion holes 22, the hexagon socket head bolt 51 is tightened so that the washer 52 presses the rod member 40 downward thereby causing the rod member 40 to descend following the first wall 24 of the seat 23. The holding member 30 receives the downwardly exerted force from the descent of rod member 40 at its inclined rear face 32 causing the holding member 30 to be pushed forward (radially inwardly) such that the two MT ferrules 1 are securely clamped between the front face 31 of the holding member 30 and the second walls 25 of the insertion holes 22.

When the holding member 30 is thus pushed forward, once the reactive force received by the front face 31 from one of the MT ferrules 1 reaches a certain degree of clamping force, the rod member 40 is urged further downwardly on the side of the other MT ferrule 1 such that the reactive force from the other MT ferrule 1 received by the front face 31 reaches the certain degree of clamping force. That is to say, because the rod member 40 can incline from a horizontal position toward either MT ferrule 1, even if some degree of difference should arise in pressure applied to any part of the front face 31, both the MT ferrules 1 can be advantageously held with a substantially equivalent degree of clamping force.

Figure 6:
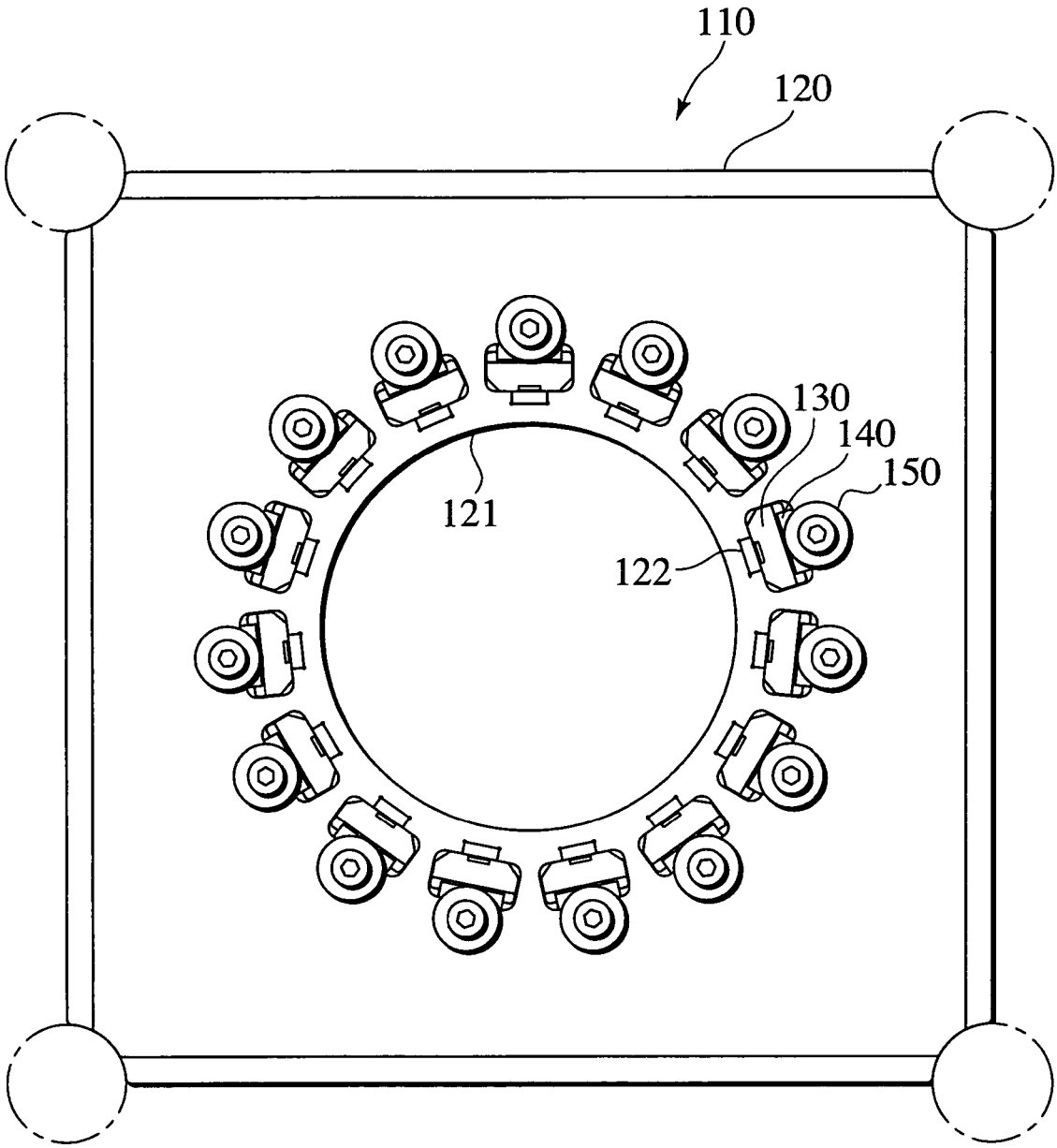
FIG. 6 is a plan view of a second embodiment of a holder for an optical fiber ferrule end face grinding apparatus according to the present invention.

FIG. 6 is a plan view of a second embodiment of a holder 110 for an optical fiber ferrule end face grinding apparatus according to the invention. Holder 110 includes a holding member 130, a rod member 140 and a depression member 150 installed for each of a plurality of insertion holes 122, into which an MT ferrule 1 can be inserted. In the embodiment shown in FIG. 6, there are fifteen (15) insertion holes 122, one for each holding member 130. Apart from those features, the holder according to the second embodiment is substantially the same as the holder according to the first embodiment. Therefore, a description of the second embodiment is provided above (using the reference numbers of the description of the first embodiment with 100 added to each number), and a detailed description and illustration of the second embodiment is omitted.

As shown in FIG. 6, the holder 110 for an optical fiber ferrule end face grinding apparatus is able to hold a plurality of MT ferrules (not shown in FIG. 6), with one MT ferrule being held by a holding member 130 at each predetermined location of a holder plate 120, in this case fifteen (15) locations.

Figure 7:
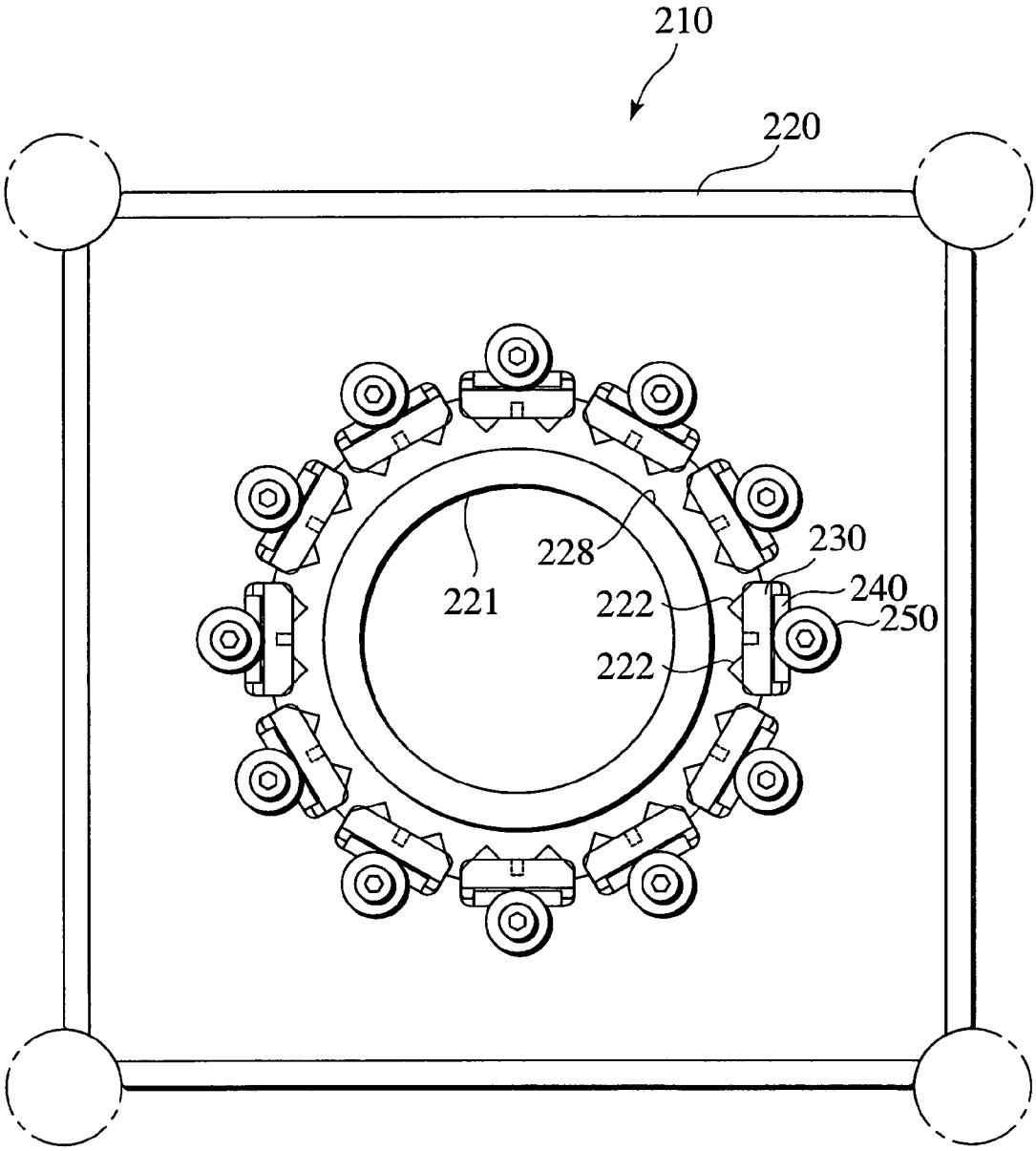
FIG. 7 is a plan view of a third embodiment of a holder for an optical fiber ferrule end face grinding apparatus according to the present invention.
Figure 8:
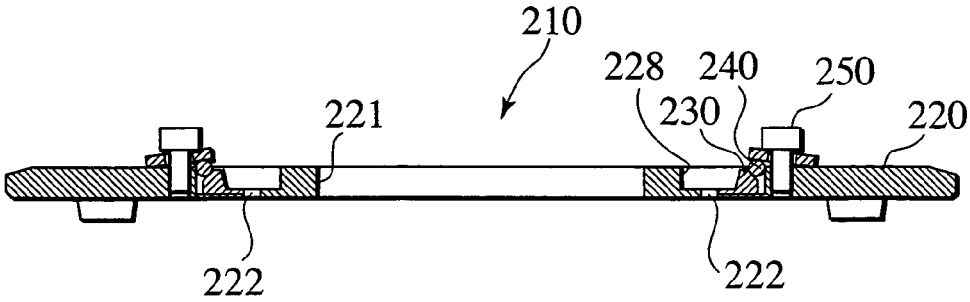
FIG. 8 is a longitudinal sectional view of the holder for an optical fiber ferrule end face grinding apparatus shown in FIG. 7.

FIG. 7 is a plan view of a third embodiment of a holder 210 for an optical fiber ferrule end face grinding apparatus according to the present invention and FIG. 8 is a longitudinal sectional view of the holder 210 shown in FIG. 7. Holder 210 mounts on an end face grinding apparatus and holds single fiber coupling (SC) ferrules 4 protruding from the ends of a plurality of SC connectors 3 (see FIGS. 11A and 11B). An SC ferrule 4 has a circular cross-sectional ferrule bore through which a single optical fiber (not shown in the drawing) is inserted. The SC connector 3 is a connector configured so as to secure the SC ferrule 4 in a predetermined location inside a connector housing.

Holder 210 for an optical fiber ferrule end face grinding apparatus comprises a holder plate 220 that mounts on an optical fiber ferrule end face grinding apparatus 60 described subsequently (see FIGS. 15 and 16), a holding member 230, a rod member 240 and a depression member 250, respectively, which are disposed at predetermined locations on the holder plate 220.

Holder plate 220 is a square-shaped plate having a notch formed in each of the four corners and a round hole 221 formed in the center thereof. A plurality of insertion holes 222, through each of which an SC connector 3 is inserted with a ferrule 4 protruding from its end, are disposed in circular formation surrounding round hole 221. In the embodiment shown in FIG. 7, twenty-four (24) insertion holes 222 are provided. Further, a circular groove 228 is formed in the holder plate 220 for accommodating the lower part of an SC connector 3 when an SC ferrule 4 is inserted in an insertion hole 222.

Figure 9A:
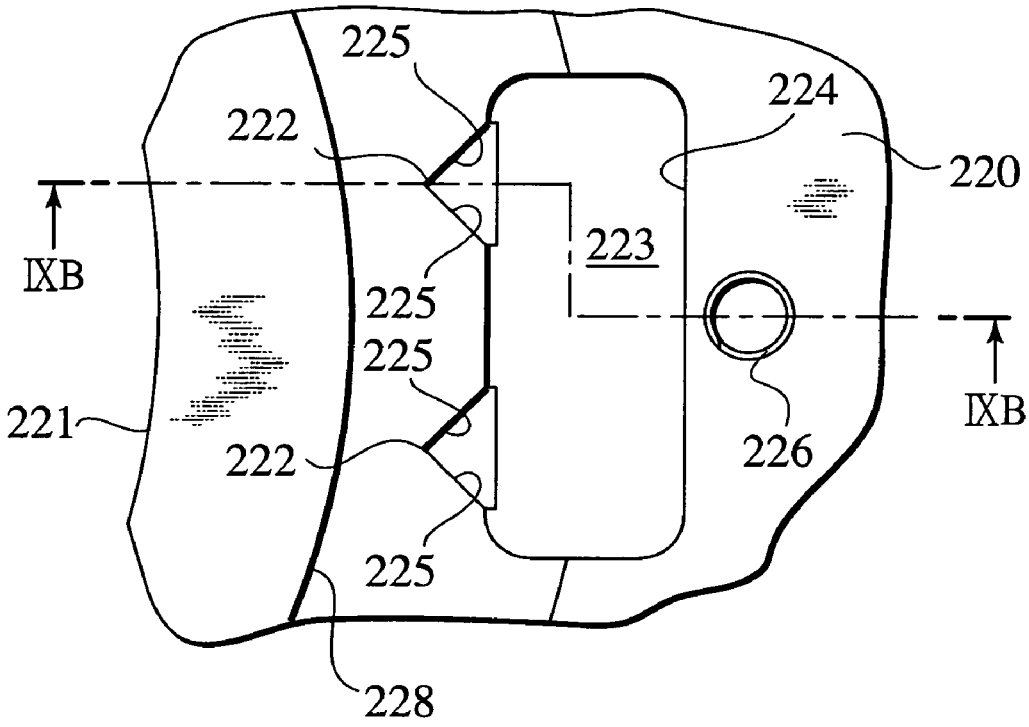
FIG. 9A is an enlarged fragmentary plan view of the major parts of the holder plate shown in FIG. 7.
Figure 9B:
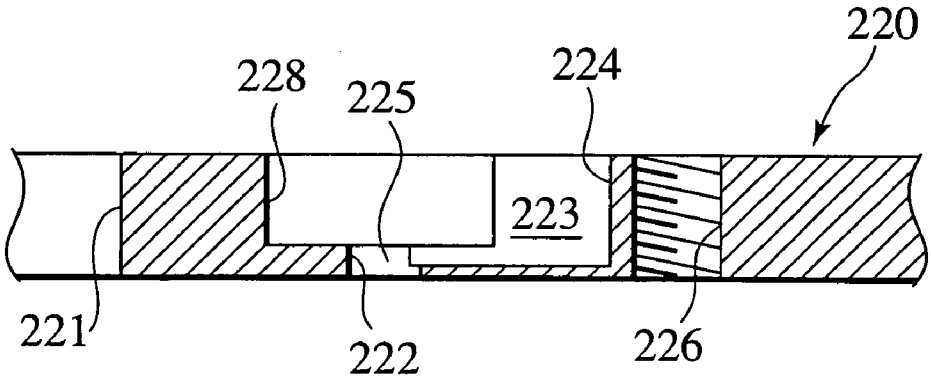
FIG. 9B is a longitudinal sectional view along the line IXB—IXB in FIG. 9A.

As shown in FIGS. 9A and 9B, because a circular cross-sectional SC ferrule 4 is to be inserted through an insertion hole 222, an insertion hole 222 is triangular in form in a plan view. An insertion hole 222 is also of a size providing a degree of additional clearance for the triangular form circumscribing the SC ferrule 4, and the two adjacent insertion holes 222 associated with each holding member 230 are formed along a straight line.

To one side of the two adjacent insertion holes 222 associated with each holding member 230 (that is, on the outer radial side in relation to the center of the hole 221), there is formed a seat 223 extending to one side of the triangular insertion holes 222. A seat 223 is provided for each of the two adjacent insertion holes 222 associated with each holding member 230. On each seat 223 at a predetermined distance from the two adjacent insertion holes 222 there is formed a first wall 224 of the seat 223. Further, on the side of the two insertion holes 222 opposite to the seat 223, that is, at each of two faces forming part of the triangular hole, are formed four vertically extending second walls 225, two for each insertion hole 222. In addition, radially outside of the first wall 224 of each seat 223, a threaded hole 226 is formed in the holder plate 220 for installing a depression member 250 in an intermediate position (midway) between the two insertion holes 222.

Figure 10A:
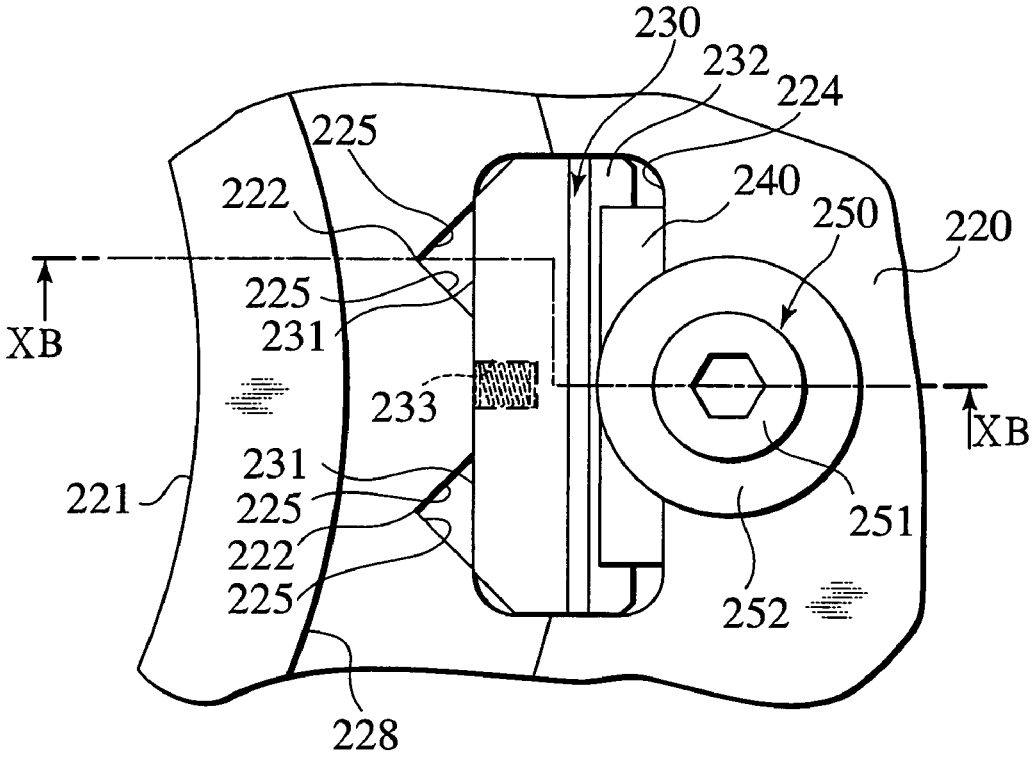
FIG. 10A is an enlarged fragmentary plan view of the major parts of the holder shown in FIG. 7.
Figure 10B:
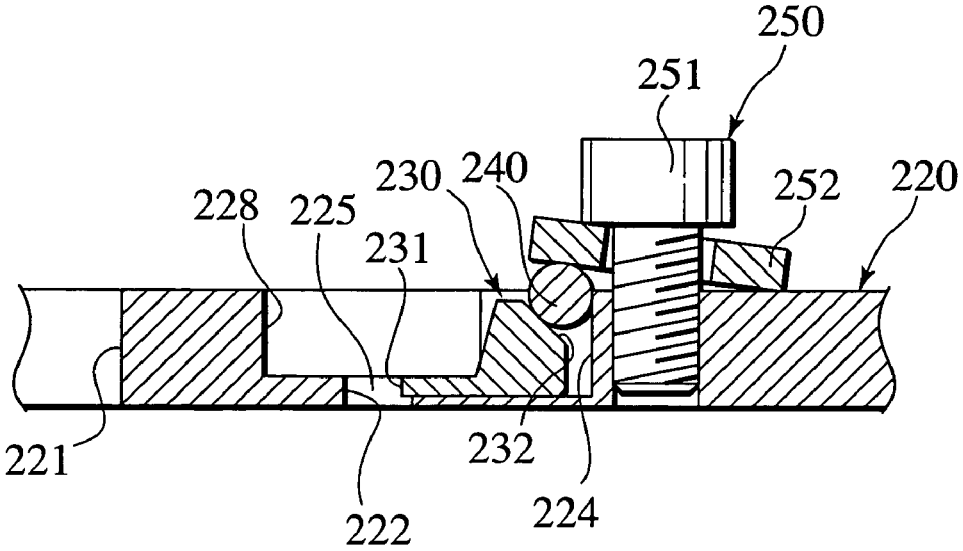
FIG. 10B is a longitudinal sectional view along the line XB—XB in FIG. 10A.

Referring now to FIGS. 10A and 10B, a holding member 230 is disposed on each seat 223 such that the holding member 230 can slide in a direction (radially in relation to the center of holder plate 220) required for adjusting the interval between the holding member 230 and the two second walls 225 of the two insertion holes 222 extending to the seat 223. Holding member 230 has a surface 231 at the front face thereof confronting the second walls 225 of the two insertion holes 222. In addition, holding member 230 has an inclined rear face 232 at the rear or radially outermost side thereof that is inclined relative to the first wall 224 of the seat 223 and extends in a direction perpendicular to the radial in and out sliding motion of the holding member 230. Holding member 230 is urged in a radial direction away from the second walls 225 by the operation of a helical compression spring 233 mounted in a bore in the front face 231 of the holding member 230.

A rod member 240 is disposed above and in contact with the inclined rear face 232 of the seated holding member 230 and in contact with the first wall 224 of the seat 223. The depression member 250 comprises a washer 252 and a hexagon socket head bolt 251 presses the rod member 240 downward. The depression member 250 comprises a hexagon socket head bolt 251, such as an Allen cap screw, that is threaded into threaded hole 226 of the holder plate 220 from above. When tightened, the depression member 250 presses the rod member 240 downwardly against the inclined rear face 232 of the holding member 230.

In accordance with the above-described construction of the holder 210 for an optical fiber ferrule end face grinding apparatus, when the hexagon socket head bolt 251 is loosened or unthreaded, the front face 231 is in a condition retracted away from the two insertion holes 222 because the holding member 230 is urged by the operation of the helical compression spring 233 in the radial direction away from the four second walls 225. In this condition, the SC ferrules 4 can be readily inserted in any of the pairs of insertion holes 222.

Figure 11A:
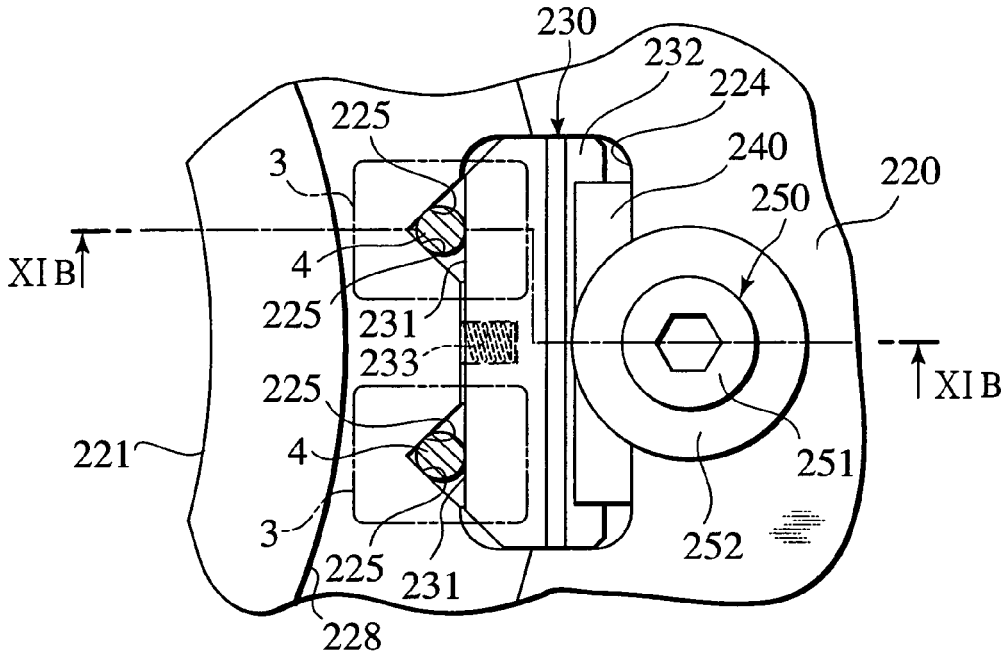
FIG. 11A is an enlarged fragmentary plan view showing an SC connector attached to the holder shown in FIG. 7.
Figure 11B:
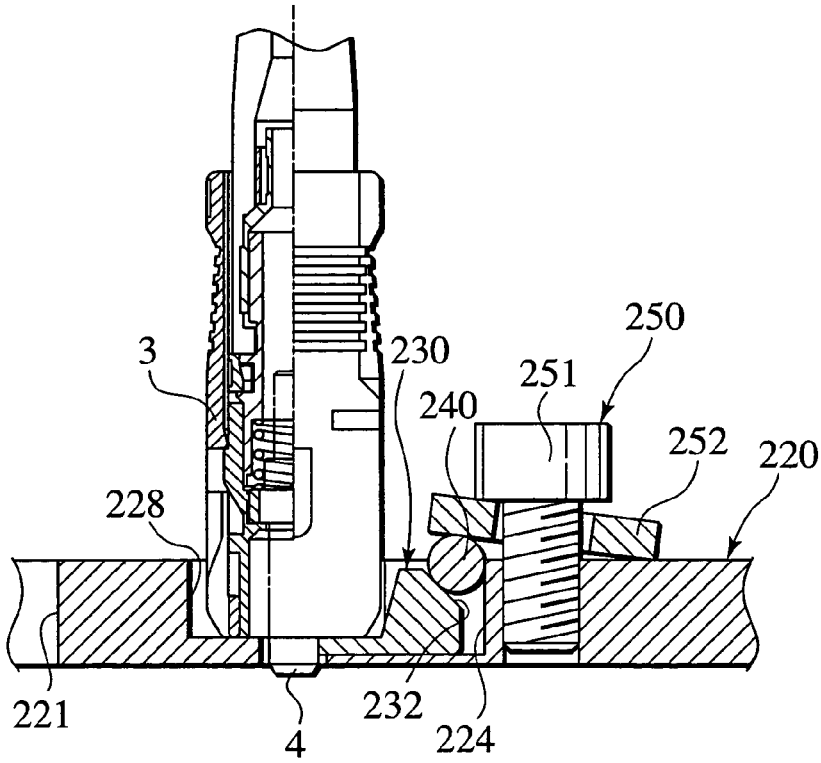
FIG. 11B is a longitudinal sectional view along the line XIB—XIB in FIG. 11A.

As shown in FIGS. 11A and 11B, after an SC ferrule 4 is inserted in each of the two insertion holes 222, the bottom portions of the SC connectors 3 are accommodated in the circular groove 228. In this condition, the hexagon socket head bolt 251 is tightened so that the washer 252 presses the rod member 240 downward thereby causing the rod member 240 to descend following the first wall 224 of the seat 223. The holding member 230 receives the downwardly exerted force from the descent of rod member 240 at its inclined rear face 232 causing the holding member 230 to be pushed forward (radially inwardly) such that the two SC ferrules 4 (and accordingly, the two SC connectors 3) are securely clamped between the front face 231 of the holding member and the four second walls 225. In other words, each SC ferrule 4 is held by the triangle formed by the two second walls 225 of each insertion hole 222 and the front face 231 of the holding member 230.

When the holding member 230 is thus pushed forward, once the reactive force received by the front face 231 from one of the SC ferrules 4 reaches a certain degree of clamping force, the rod member 240 is urged further downwardly on the side of the other SC ferrule 4 such that the reactive force from the other SC ferrule 4 received by the front face 231 reaches the certain degree of clamping force. That is to say, because the rod member 240 can incline from a horizontal position toward either SC ferrule 4, even if some degree of difference should arise in pressure applied to any part of the front face 231, both the SC ferrules 4 can be advantageously held with a substantially equivalent degree of clamping force.

Figure 12:
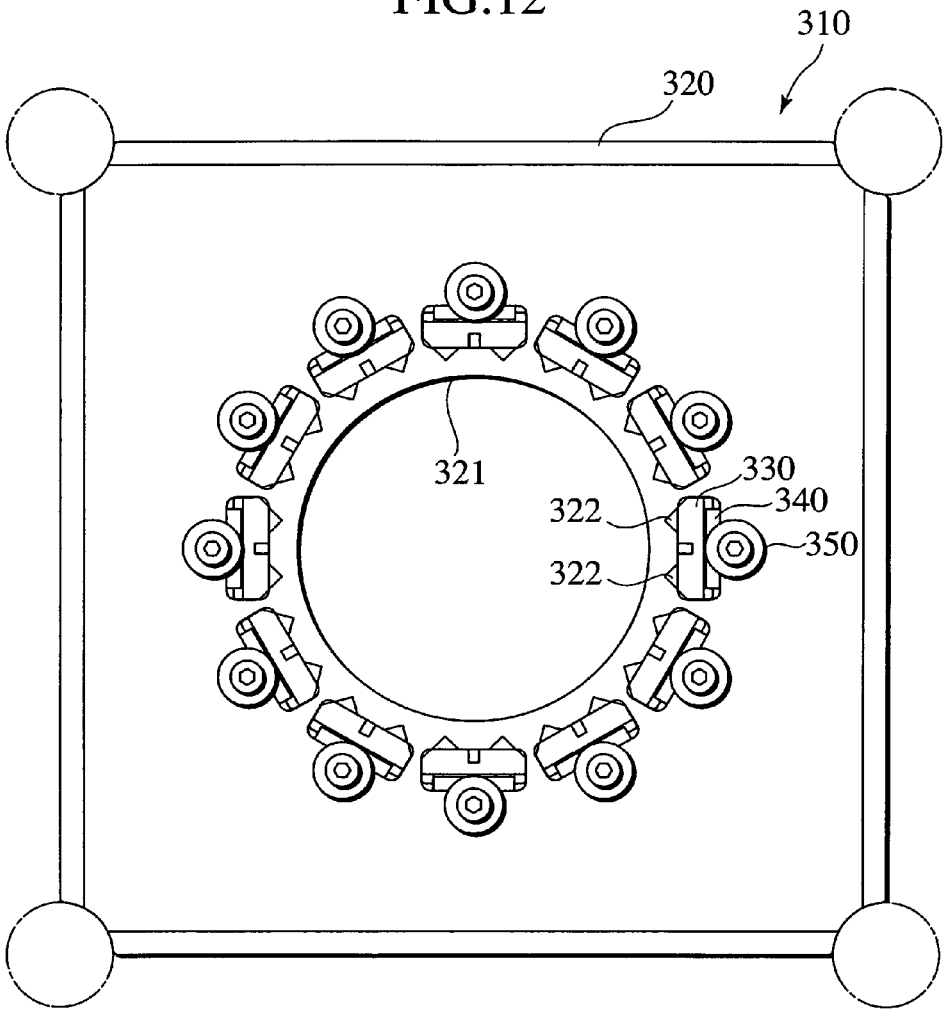
FIG. 12 is a plan view of a fourth embodiment of a holder for an optical fiber ferrule end face grinding apparatus according to the present invention.
Figure 13:
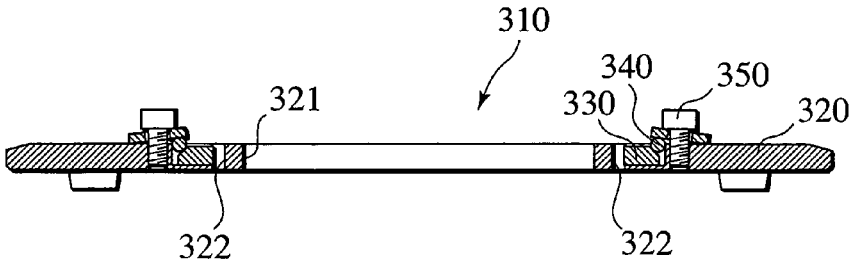
FIG. 13 is a longitudinal sectional view of the holder for an optical fiber ferrule end face grinding apparatus shown in FIG. 12.

FIG. 12 is a plan view of a fourth embodiment of a holder 310 for an optical fiber ferrule end face grinding apparatus according to the invention and FIG. 13 is a longitudinal cross-sectional view of the holder 310 shown in FIG. 12. Holder 310 holds a number of SC ferrules 4. In this embodiment, an SC ferrule 4 is not inserted in an SC connector but the SC ferrule 4 is subject to grinding processes independently of an SC connector.

Because the holder 310 for an optical fiber ferrule end face grinding apparatus is not required to hold SC connectors, the fourth embodiment is distinguished from the third embodiment by the fact that (1) a circular groove for accommodating the lower part of an SC connector is not provided in holder plate 320 and (2) the cross-sectional form of the holding member 330 is different from the holding member 230. However, apart from those differences, the holder according to the fourth embodiment is substantially the same as the holder according to the third embodiment. Accordingly, a description of the fourth embodiment is provided above (using the reference numbers of the description of the third embodiment with 100 added to each number), and a detailed description and illustration of the fourth embodiment is omitted.

Figure 14A:
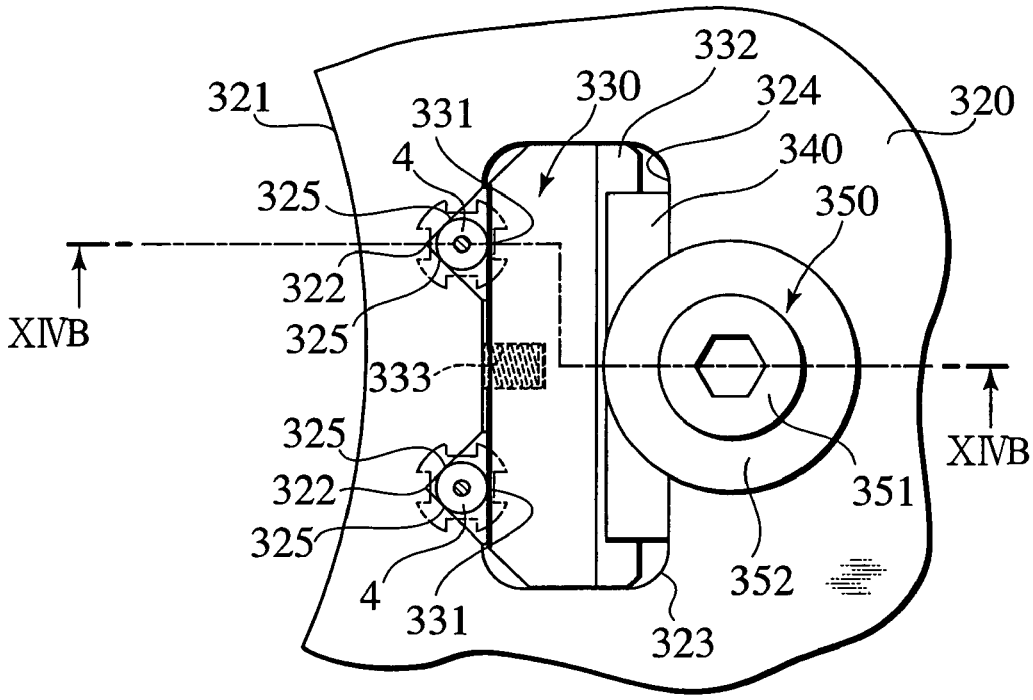
FIG. 14A is an enlarged fragmentary plan view showing an SC ferrule attached to the holder shown in FIG. 12.
Figure 14B:
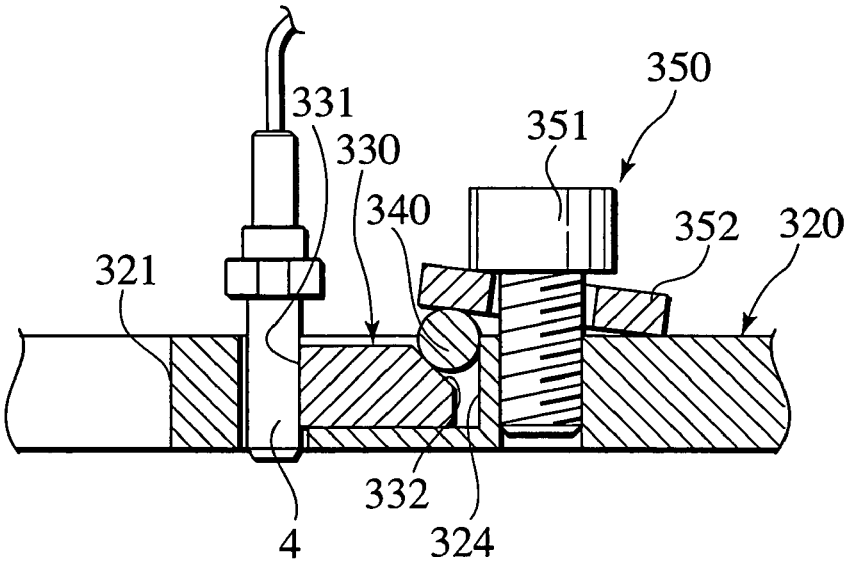
FIG. 14B is a longitudinal sectional view along the line XIVB—XIVB in FIG. 14A.

As can be seen from FIGS. 14A and 14B, with the holder 310 for an optical fiber ferrule end face grinding apparatus, when the hexagon socket head bolt 351 is loosened, the front face 331 is in a condition retracted from the two insertion holes 322 because the holding member 330 is urged by the operation of the helical compression spring 333 in the radial direction away from the four second walls 325. In this condition, the SC ferrules 4 can be readily inserted in any of the two insertion holes 322 for each holding member position.

As shown in FIGS. 14A and 14B, after an SC ferrule 4 is inserted in each of the two insertion holes 322, the hexagon socket head bolt 351 is tightened so that the washer 352 presses the rod member 340 downward thereby causing the rod member 340 to descend following the first wall 324 of the seat 323. The holding member 330 receives the downwardly exerted force from the descent of rod member 340 at its inclined rear face 332 causing the holding member 330 to be pushed forward (radially inwardly) such that the two SC ferrules 4 are securely clamped between the front face 331 of the holding member 330 and the four second walls 325. In other words, each SC ferrule 4 is clamped by the triangle formed by the two second walls 325 of each insertion hole 322 and the front face 331 of the holding member 330.

When the holding member 330 is thus pushed forward, once the reactive force received by the front face 331 from one of the SC ferrules 4 reaches a certain degree of clamping force, the rod member 340 is urged further downwardly on the side of the other SC ferrule 4 such that the reactive force from the other SC ferrule 4 received by the front face 331 reaches the certain degree of clamping force. That is to say, because the rod member 340 can incline from a horizontal position toward either SC ferrule 4, even if some degree of difference should arise in pressure applied to any part of the front face 331, both the SC ferrules 4 can be advantageously held with a substantially equivalent degree of clamping force.

Figure 15:
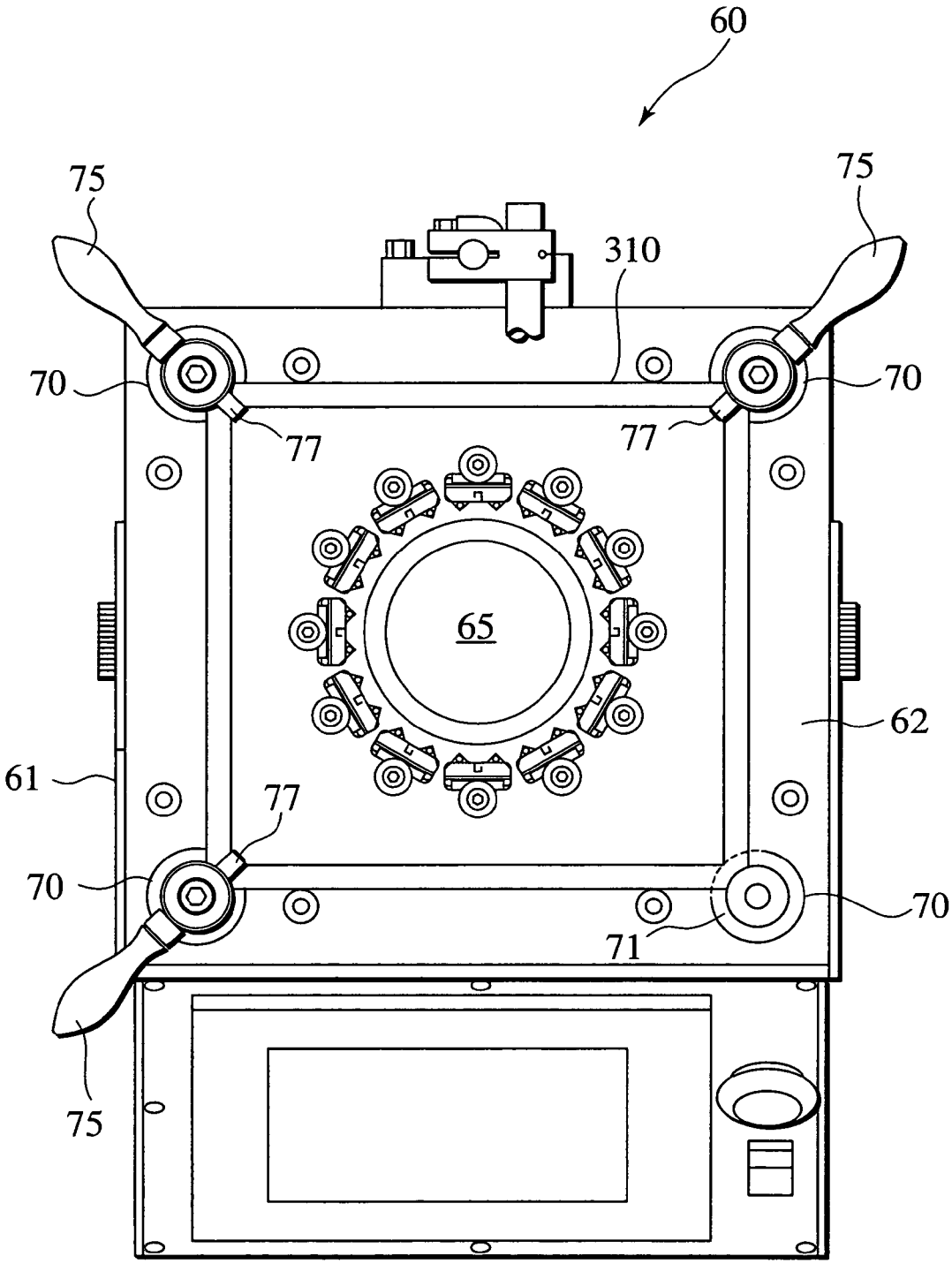
FIG. 15 is a plan view showing an optical fiber ferrule end face grinding apparatus in which the holder shown in FIG. 7 is attached.
Figure 16:
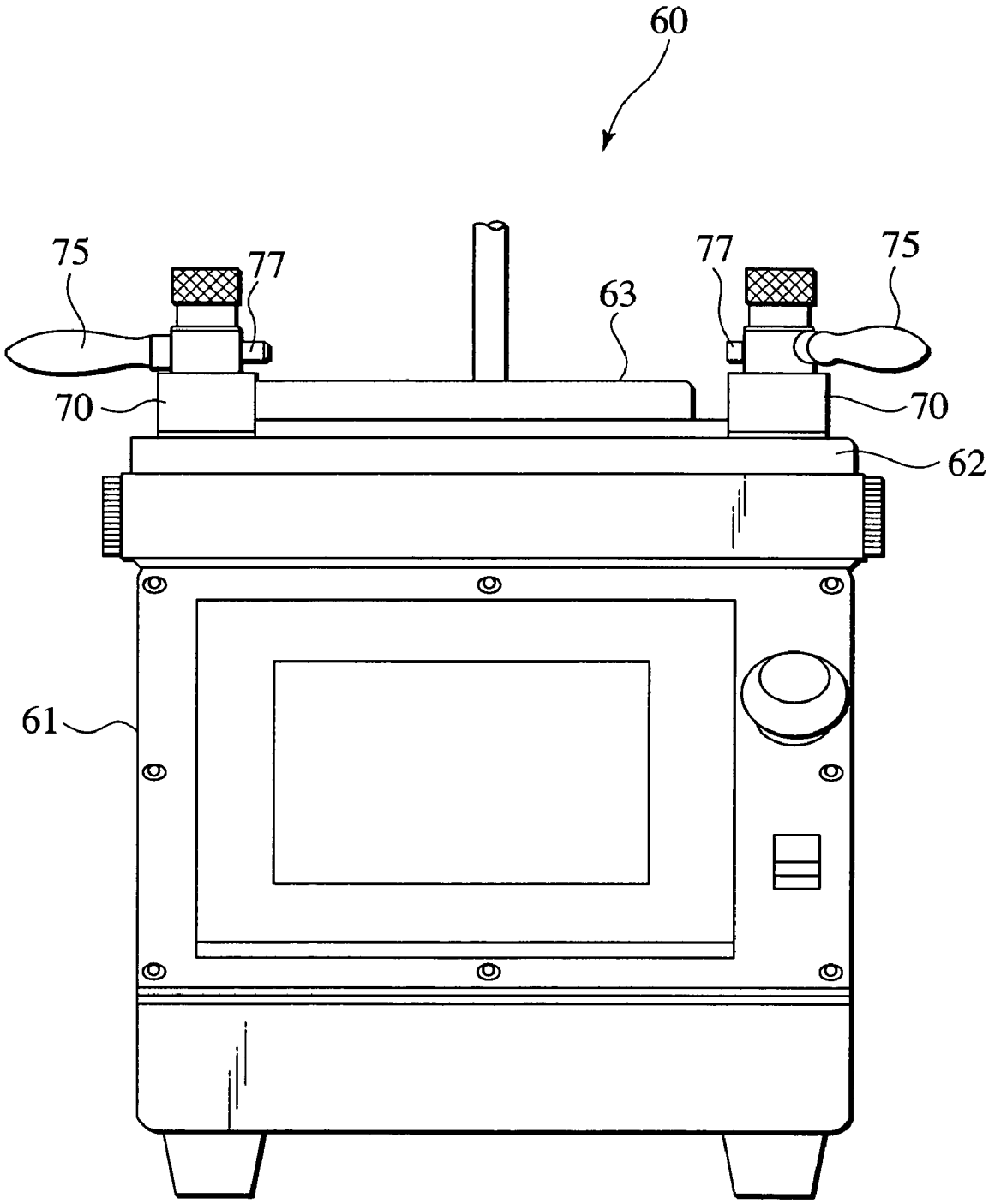
FIG. 16 is a front view of the optical fiber ferrule end face grinding apparatus of FIG. 15 shown without a holder attached.

FIGS. 15 and 16 show an optical fiber ferrule end face grinding apparatus 60 on which are mounted the above-described holders for an optical fiber ferrule end face grinding apparatus. Grinding apparatus 60 grinds the end faces of MT ferrules 1 or SC ferrules 4 (in other words the optical fiber end faces) that are held by any of the holders. In the example of FIGS. 15 and 16, the grinding apparatus 60 is shown with the holder 310 according to the fourth embodiment mounted thereon, however, any of the holders 10, 110 or 210 according to the other above-described embodiments could also be so mounted.

The optical fiber ferrule end face grinding apparatus 60 comprises a turntable 63 that rotates in a horizontal plane and is installed in the center of a square base 62 located on the upper surface of a housing 61, and a grinding pad 64 and grinding film 65 mounted on the flat, upper surface of turntable 63.

Figure 17A:
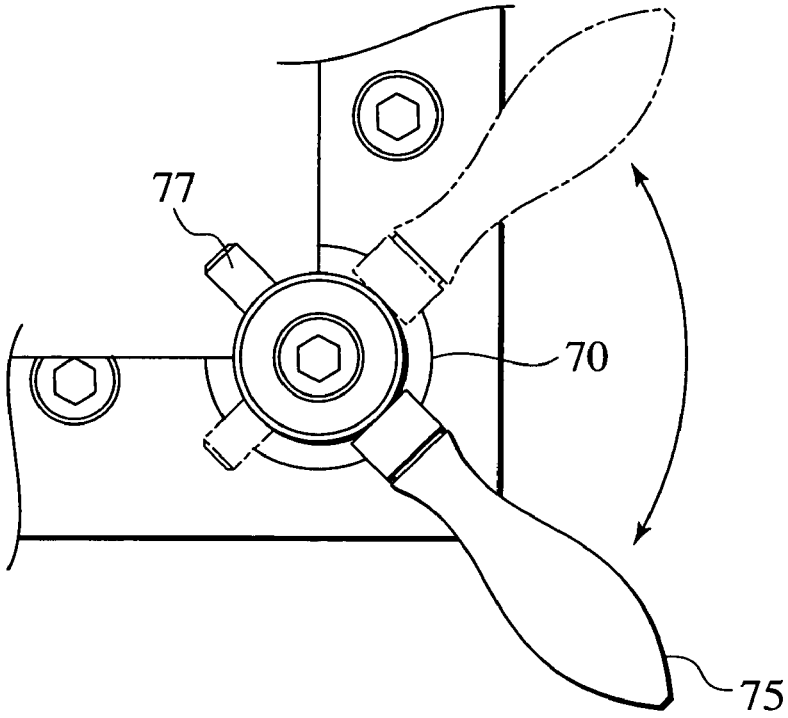
FIG. 17A is a fragmentary plan view showing a holder according to an embodiment of the present invention attached to the optical fiber ferrule end face grinding apparatus shown in FIG. 15.
Figure 17B:
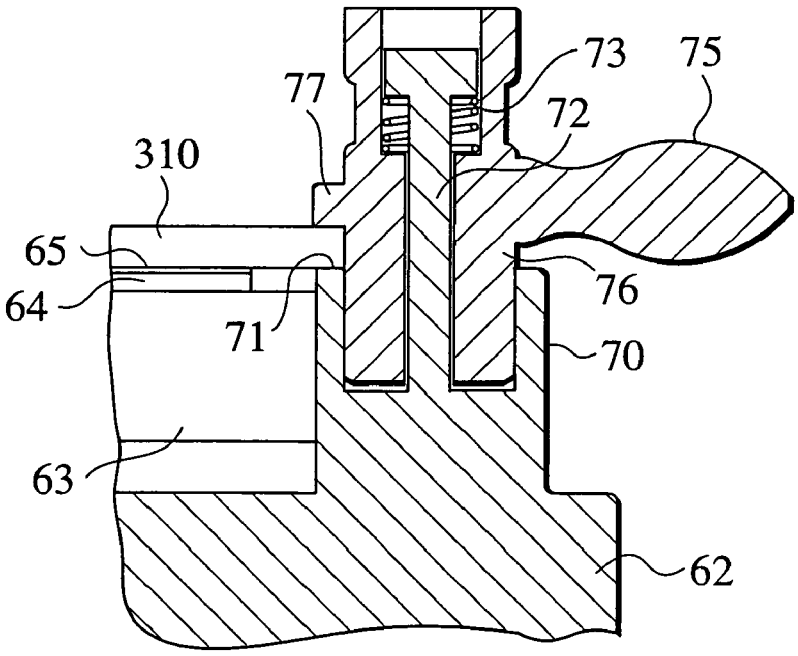
FIG. 17B is a longitudinal cross-sectional view of a holder according to the present invention attached to the optical fiber ferrule end face grinding apparatus shown in FIG. 15.

Four cylindrical posts 70 are installed at the four corners of the base 62. A pressure lever 75 is installed on each of these posts 70. The plan view of FIG. 17A and the longitudinal sectional view of FIG. 17B show the installation of a holder 310 (10, 110, or 210) by a pressure lever 75 that is omitted at the lower right corner of the base as shown in FIG. 15. That is to say, the size of the holder 310 (10, 110 or 210) is such that each of the circular arcuate edges at the four corners of the holder plate 320 (20, 120 or 220) are conveniently placed on the top annular surface 71 of each of the four posts 70. Further, a sleeve part 76 of each pressure lever 75 is inserted with a shaft part 72 of the post 70, such that the lever 75 is installed in a downwardly compressed state by the force applied from the pressure spring 73. The orientation of a pressure pin 77 can be changed as the lever 75 is turned by hand. Accordingly, when installing the holder 310 (10, 110 or 210), the pressure pins 77 are each directed towards the outer side by turning the four pressure levers 75. Then, by placing the circular arcuate edge of each of the four corners of the holder plate 320 (20, 120 or 220) on the top surfaces 71 of each of the four posts 70 and pulling upwards to turn each of the pressure levers 75 thereby bringing each pressure pin 77 to press from above on each of the four corners of the holder plate 320 (20, 120 or 220), the holder plate is fixed in place.

When the holder 310 (10, 110 or 210) is secured in position on each of the four posts 70 of the optical fiber ferrule end face grinding apparatus 60 in this way, the height of each post 70 can be adjusted so that the ends of MT ferrules 1 or SC ferrules 4 protruding from the bottom face of the holder 310 (10, 110, or 210) are pressed to the prescribed degree (for example 0.1 mm) into the grinding film 65.

The above-described embodiments have one seat (for example, 23 or 223) for each insertion hole or each grouping of two adjacent insertion holes (for example, 22 or 222), however this configuration is illustrative and not restrictive. Thus, for example, one seat can be provided for three or more adjacent insertion holes.

Further, in the above-described embodiments, depending on the shape of the ferrule, a ferrule is held by one face or second wall (e.g., second wall 25) and the front face (e.g., front face 31) of the holding member (e.g., holding member 30) or by two faces or second walls (e.g., second walls 225) and the front face (e.g., front face 231) of the holding member (e.g., holding member 230). However, this also is not restrictive and a ferrule can be held by more than three faces of second walls or a second wall with a curved shaped surface, and a front face of a holding member.

In the above-described embodiments, the depression member (e.g., 50 or 250) is configured by a washer (e.g., 52 or 252) and a screw (e.g., 51 or 251) that threads from above into the holder plate (e.g., 20 or 220). However, this is illustrative and not restrictive and a suitable depression member can also be configured using a toggle clamp, for example.

In the above description of the embodiments of the present invention, there is no explanation for the angle of each of the insertion holes (e.g., 22, 222 or 322) with respect to the planar surface of the holder plate (e.g., 20, 220 or 320), however, depending on the grinding angle required for the end face of the ferrule or optical fiber in relation to the planar surface of the holder plate, each insertion hole can be inclined perpendicularly or to a desired angle with respect to the planar surface of the holder plate.

As described above, a holder for an optical fiber ferrule end face grinding apparatus according to this invention is configured such that the holder holds a plurality of optical fiber ferrules and the holder comprises:

a holder plate provided with a plurality of insertion holes into each of which one of said ferrules is inserted, a seat provided for all of said insertion holes that extends to one side of at least one of said insertion holes and has a first wall at a prescribed distance from the insertion hole, and a second wall provided on a side of the insertion hole opposing said seat;

a holding member disposed on each of said seats that is slidable in a direction to adjust the interval between the holding member and said second wall, the holding member including a front face facing said second wall, and a rear face that is inclined relative to the first wall;

a rod member disposed above said inclined rear face of said holding member; and a depression member provided on the holder plate at an outside of said first wall of each said seat, that exerts depression pressure on said rod member, wherein by the operating of each said depression member, each of said rod members is pressed downwardly along said first wall of each of said seats, by which action each of said holding members is pushed out forwardly such that each said ferrule is held by said front face of the holding member and said second wall.

Accordingly, rather than using the peripheral face of the holder plate, the upper face of the holder plate that is broader than the peripheral face and thus allows a broader area to be used, thereby enabling more effective usage of space of the holder plate. This enables the number of optical fiber ferrules that can be ground each time to be increased, resulting in a reduction in the cost of grinding each optical fiber ferrule.

While the invention has been shown and described in detail, the foregoing description is in all aspects illustrative and not restrictive. It is therefore understood that numerous modifications and variations can be devised without departing from the spirit or scope of the following claims of the invention.

What is claimed is:

1. A holder for an optical fiber ferrule end face grinding apparatus that holds a plurality of optical fiber ferrules, the holder comprising:

a holder plate provided with a plurality of insertion holes into each of which one of said ferrules is inserted, a seat provided for said insertion holes that extends to one side of at least one of said insertion holes, said seat having a first wall located at a distance from the insertion hole, and a second wall provided on a side of the insertion hole opposite said seat;

a holding member disposed on said seat, said holding member being slidable in a direction to adjust the spacing between the holding member and said second wall, the holding member including a front face confronting said second wall, and a rear face inclined relative to the first wall;

a rod member disposed on said inclined rear face of said holding member; and a depression member provided on the holder plate at an outside of said first wall of said seat that exerts a force on said rod member, wherein by the operating of said depression member, said rod member is pressed downwardly along said first wall of said seat, by which action said holding member is pushed out forwardly such that said ferrule is held by said front face of the holding member and said second wall.

2. A holder for an optical fiber ferrule end face grinding apparatus according to claim 1, wherein a seat is provided for a group of adjacent insertion holes, said inclined rear face extends horizontally in a direction perpendicular to the direction of the sliding motion of said holding member, said plurality of ferrules inserted in said adjacent insertion holes being held by said front face of said holding member disposed on each said seat together with said second walls of said adjacent insertion holes.

3. A holder for an optical fiber ferrule end face grinding apparatus according to claim 1, wherein said plurality of insertion holes is formed in a circular formation on said holder plate and each seat is provided at the outside in relation to the center of said circular formation of said insertion holes.

4. A holder for an optical fiber ferrule end face grinding apparatus according to claim 1, wherein each holding member is biased in a direction away from said second wall.

5. A holder for an optical fiber ferrule end face grinding apparatus according to claim 1, wherein each second wall holds a ferrule inserted into said insertion hole by one or a plurality of faces depending on the shape of said ferrule.

6. A holder for an optical fiber ferrule end face grinding apparatus according to claim 1, wherein said depression member comprises a washer and a screw that is threaded into said holder plate from above.

7. A holder for an optical fiber ferrule end face grinding apparatus according to claim 1, wherein the axis of each insertion hole is inclined perpendicularly or at a given angle with respect to a planar surface of said holder plate.

8. A holder for an optical fiber ferrule end face grinding apparatus according to claim 1, wherein each insertion hole has a rectangular cross-section in plan view of said holder plate.

9. A holder for an optical fiber ferrule end face grinding apparatus according to claim 1, wherein each insertion hole has a triangular cross-section in plan view of said holder plate.

10. A holder for an optical fiber ferrule end face grinding apparatus according to claim 1, wherein each combination of seat, holding member, rod member, and depression member is associated with at least two insertion holes.

11. A holder for an optical fiber ferrule end face grinding apparatus for holding a plurality of optical fiber ferrules, the holder comprising:

a holder plate having a plurality of insertion holes arranged about the center of said holder plate, each insertion hole adapted to receive one of said ferrules, a seat provided in said holder plate for at least one of said insertion holes, said seat extending radially outside of said one insertion hole, said seat having a first wall spaced radially outwardly from said one insertion hole, a second wall provided on a side of the insertion hole radially inwardly of said first wall;

a holding member adapted to be mounted on said seat, said holding member having a front face confronting said second wall and a rear face inclined relative to the first wall, said holding member being slidable in said seat in a radial direction to adjust the spacing between the front face of the holding member and said second wall;

a rod member adapted to bear against said inclined rear face of said holding member; and a depression member adapted to be attached to the holder plate radially outwardly of said first wall, said depression member adapted to exert a force on said rod member so as to urge the holding member toward said second wall.

12. A holder for an optical fiber ferrule end face grinding apparatus according to claim 11, wherein said plurality of insertion holes are arranged in pairs, a seat is provided in said holder plate for each pair of insertion holes.

13. A holder for an optical fiber ferrule end face grinding apparatus according to claim 11, wherein said seats are arranged in a circle about the center of said holder plate, said insertion holes being arranged in pairs, each pair of insertion holes and the front faces of said holding members being arranged parallel to chords of said circle.

14. A holder for an optical fiber ferrule end face grinding apparatus according to claim 11, wherein the holder plate has an upper planar surface, an annular groove formed in the upper surface of said holder plate intersecting said seat.

15. A holder for an optical fiber ferrule end face grinding apparatus according to claim 11, including a compression spring arranged in a bore on the front face of the holding member for urging the holding member outwardly away from the second wall.

16. A holder for an optical fiber ferrule end face grinding apparatus according to claim 11, wherein each insertion hole has one of a rectangular or triangular cross-section in plan view of said holder plate.

17. A holder for an optical fiber ferrule end face grinding apparatus according to claim 11, wherein said rod member engages both the inclined rear face of said holding member and the first wall of said seat such that a force applied to the rod member by the depression member urges holding member radially inwardly and slidably in said seat.

18. A holder for an optical fiber ferrule end face grinding apparatus according to claim 11, wherein said seat intersects at least one insertion hole and the second wall forms at least a part of said one insertion hole.

19. A holder for an optical fiber ferrule end face grinding apparatus according to claim 11, wherein said second wall comprises four surfaces, each surface being arranged at an angle relative to said first wall.

20. A holder for an optical fiber ferrule end face grinding apparatus according to claim 11, wherein said second wall comprises two surfaces, each surface being arranged parallel to said first wall.

* * * * *